US010712064B2

(12) United States Patent
Spies et al.

(10) Patent No.: US 10,712,064 B2
(45) Date of Patent: Jul. 14, 2020

(54) APPARATUS FOR SEPARATING AND STORING LIQUID REFRIGERANT IN REFRIGERANT CIRCUIT

(71) Applicant: Hanon Systems, Daejeon (KR)

(72) Inventors: Toni Spies, Köln (DE); Peter Heyl, Köln (DE); Marc Graaf, Krefeld (DE); Hartmut Helm, Bonn (DE); Heinrich Ittner, Fischen a.A. (DE); Jiri Dvorsky, Kerpen (DE)

(73) Assignee: HANON SYSTEMS, Daejeon (KR)

( * ) Notice: Subject to any disclaimer, the term of this patent is extended or adjusted under 35 U.S.C. 154(b) by 105 days.

(21) Appl. No.: 15/388,055

(22) Filed: Dec. 22, 2016

(65) Prior Publication Data

US 2017/0176069 A1 Jun. 22, 2017

(30) Foreign Application Priority Data

Dec. 22, 2015 (DE) ..... 10 2015 122 549
Dec. 22, 2015 (DE) ..... 10 2015 122 556

(51) Int. Cl.
*F25B 43/00* (2006.01)

(52) U.S. Cl.
CPC ..... *F25B 43/006* (2013.01); *F25B 43/003* (2013.01); *F25B 2400/23* (2013.01); *F25B 2500/28* (2013.01)

(58) Field of Classification Search
CPC .. F25B 43/006; F25B 43/003; F25B 2400/23; F25B 2500/28
See application file for complete search history.

(56) References Cited

U.S. PATENT DOCUMENTS 4,457,843 A * 7/1984 Cullen ..... B01D 15/00 210/282
4,474,035 A * 10/1984 Amin ..... F25B 43/006 55/391
5,233,842 A 8/1993 Manning et al.
(Continued)

FOREIGN PATENT DOCUMENTS

DE 10154375 A1 7/2002
DE 69819244 T2 4/2004
(Continued)

*Primary Examiner* — Frantz F Jules
*Assistant Examiner* — Lionel Nouketcha
(74) *Attorney, Agent, or Firm* — Shumaker, Loop & Kendrick, LLP; James D. Miller

(57) ABSTRACT

An apparatus for separating and storing liquid refrigerant in a refrigerant circuit including a housing configured as a refrigerant collection container, the housing having a refrigerant outflow line disposed therein. The refrigerant outflow line extending from an inlet opening, which is disposed in a gas refrigerant region and above a level of the liquid refrigerant, via a liquid refrigerant region to the outside, and has a through-opening formed in the liquid refrigerant region. The housing includes a boiling element for liquid refrigerant disposed therein. The boiling element is connected to the refrigerant outflow line in the region of the through-opening, such that a liquid passing through the through-opening from the housing passes through the boiling element by suction of a gas refrigerant.

9 Claims, 7 Drawing Sheets

(56) References Cited

U.S. PATENT DOCUMENTS

| | | | | | |
|---|---|---|---|---|---|
| 5,471,854 | A * | 12/1995 | DeNolf | F25B 43/006 | 62/135 |
| 5,507,159 | A | 4/1996 | Cooksey | | |
| 5,778,697 | A * | 7/1998 | Wantuck | F25B 31/004 | 62/471 |
| 5,914,456 | A * | 6/1999 | LeConey | B01D 53/0415 | 210/282 |
| 5,970,738 | A * | 10/1999 | DeNolf | B01D 29/15 | 62/474 |
| 6,167,720 | B1 * | 1/2001 | Chisnell | F25B 43/003 | 62/474 |
| 6,311,514 | B1 * | 11/2001 | Chisnell | F25B 43/006 | 62/503 |
| 6,389,842 | B1 | 5/2002 | Telesz et al. | | |
| 6,442,965 | B1 * | 9/2002 | Paesante | F25B 43/006 | 62/505 |
| 6,481,241 | B1 * | 11/2002 | Fisk | B01D 53/0415 | 62/475 |

FOREIGN PATENT DOCUMENTS

| | | | |
|---|---|---|---|
| DE | 102013224211 | A1 | 6/2015 |
| JP | 2008267718 | A | 11/2008 |
| KR | 20030002962 | A | 1/2003 |
| KR | 20040064483 | A | 7/2004 |

* cited by examiner

APPARATUS FOR SEPARATING AND STORING LIQUID REFRIGERANT IN REFRIGERANT CIRCUIT

CROSS-REFERENCE TO RELATED APPLICATIONS

This patent application claims priority to German Patent Application Nos. 10 2015 122 549.2 and 10 2015 122 556.5 filed on Dec. 22, 2015, the disclosures of which are incorporated herein by reference in their entirety.

FIELD OF THE INVENTION

Exemplary embodiments of the present invention relate to an apparatus for separating and storing liquid refrigerant in a refrigerant circuit. The apparatus includes a housing defined as a refrigerant collection container, in which case the housing has a refrigerant outflow line disposed therein. The refrigerant outflow line extends from an inlet opening, which is disposed in a gas refrigerant region and above a level of refrigerant, via a liquid refrigerant region to the outside. The refrigerant outflow line has a through-opening formed in the liquid refrigerant region. The housing includes a boiling element for liquid refrigerant disposed therein.

BACKGROUND OF THE INVENTION

In various applications of refrigerant circuits of compression refrigerators known in the related art, a refrigerant collector is disposed next to a heat exchanger, which is operated as an evaporator, in the flow direction of refrigerant. The refrigerant collector, which is disposed next to the evaporator and is referred to as an accumulator, serves as a separator used to store a refrigerant and separate the phase of the refrigerant discharged from the evaporator, in which case the refrigerant is a two-phase mixture formed of gas refrigerant and liquid refrigerant. In addition, the accumulator is used to dry and filter a refrigerant. In typical and conventional refrigerant circuits, particularly refrigerant circuits used for heat pump systems, a compressor is disposed next to an accumulator in the flow direction of refrigerant, and the compressor drops the pressure of refrigerant in the accumulator when the refrigerant circuit is first operated. In particular, when a large amount of liquid is present in the accumulator, the temperature of the liquid is not decreased at the same rate as a saturation temperature related to the pressure of refrigerant. As a result of the pressure drop, the boiling temperature of the refrigerant stored in the accumulator is often lowered more quickly than the temperature of liquid refrigerant. Hence, the refrigerant is present as a superheated liquid that can be suddenly evaporated due to an already low impulse. The sudden evaporation of superheated liquid refrigerant, which refers to a retardation of boiling, causes the liquid refrigerant to be suddenly changed to a gas refrigerant, which may lead to a significant decrease in density. The decrease in density is related to an extreme increase in inherent capacity again. Subsequently, the sudden increase of the pressure in the accumulator, which is caused by the extreme increase in inherent capacity, generates a pressure wave flowing in the whole refrigerant circuit of the system. Such a pressure wave causes vibration and unintended noise again. The pressure increase may sound like explosion depending on the intensity of the pressure and may be detected, particularly in the vicinity of the accumulator depending on vibration. Moreover, the variation in pressure and the vibration apply a significant load to the refrigerant circuit or the parts of the compression refrigerator, and therefore the parts may be damaged. In the retardation of boiling, typical containers, each having a high surface quality but having a small wetted surface area, has a very weak resistance.

For example, the above-mentioned accumulator is disclosed in U.S. Pat. No. 5,970,738. The accumulator has a J-shaped pipe formed at the outlet thereof in order to suck gas refrigerant and liquid oil, and the pipe is disposed in the housing of the accumulator. The pipe may at least come into local contact with the liquid phase of the fluid. The J-shaped pipe is generally smooth for recirculation of gas refrigerant from the accumulator to the compressor. The surface area of the pipe coming into contact with liquid refrigerant may not ensure that gas bubbles are formed enough to block an imminent retardation of boiling to a desired extent.

In order to prevent noise caused by the retardation of boiling and noise such as a sound of explosion in the accumulator, U.S. Pat. No. 6,389,842 discloses an accumulator including an outlet pipe having an increased flow cross section. The accumulator includes a J-shaped refrigerant outflow line disposed therein, and the refrigerant outflow line has a locally increased cross section and also has an addition capacity at the outlet or inlet thereof. When a compressor, which is disposed next to the accumulator in the flow direction of refrigerant, is switched on at an equal operating point, the drop of the pressure in the accumulator is delayed compared to an accumulator which does not have an increased flow cross section. Furthermore, the increase in flow cross section causes a lower flow velocity of refrigerant. As a result, when the compressor is switched on, the liquid refrigerant in the refrigerant outflow line is evaporated and the risk of the retardation of boiling is reduced. However, when the above-proposed solution is used, only a pressure drop process is delayed and the superheating of liquid is slightly reduced. It is impossible to actively introduce the retardation of boiling by design action and to prevent the retardation of boiling of liquid refrigerant outside the J-shaped pipe.

In addition, typical accumulators aim to preventing only the retardation of boiling of the liquid in a J-shaped pipe. However, such a retardation of boiling may also occur in the liquid which is stored outside the pipe or is separated therefrom. Since a relatively larger amount of liquid is present outside the pipe, the retardation of boiling causes a sudden potentiality of evaporation and a degree of noise to be very high. The risk of the retardation of boiling of the liquid stayed outside the pipe is particularly increased in the accumulator of the refrigerant circuit of the heat pump system.

Additionally, in accumulators known in the related art, it is impossible to actively introduce an evaporation process of liquid in a J-shaped pipe. The stagnant liquid causes the evaporation process to begin over long time intervals without a retardation of boiling due to the relatively slow drop of suction pressure.

SUMMARY OF THE INVENTION

An object of the present invention is to provide an apparatus for separating and storing liquid refrigerant, particularly an accumulator for a refrigerant circuit of a compression refrigerator, capable of reducing a risk of retardation of boiling of liquid refrigerant which is stored outside an outlet pipe or separated therefrom. In particular, the apparatus must improve sound behavior in a refrigerant circuit of a vehicle having an electric drive device, a hybrid drive device, and an internal combustion engine drive device. The apparatus must also be adapted for a heat pump system. Moreover, the apparatus must be manufactured, maintained, and installed at minimal costs.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, the above and other objects can be accomplished by the provision of an apparatus for separating and storing liquid refrigerant in a refrigerant circuit. The apparatus includes a housing defined as a refrigerant collection container, in which case the housing has a refrigerant outflow line disposed therein. The refrigerant outflow line extends from an inlet opening, which is disposed in a gas refrigerant region and above a level of refrigerant, via a liquid refrigerant region to the outside, and has a through-opening formed in the liquid refrigerant region. The housing includes a boiling element for liquid refrigerant disposed therein.

According to the concept of the present invention, the boiling element is disposed in such a way to be connected to the refrigerant outflow line in the region of the through-opening, such that a liquid passing through the through-opening from the housing passes through the boiling element by suction of gas refrigerant. In this case, the whole mass flow of the liquid preferably flows through the boiling element. The refrigerant outflow line extends to the outside from the inlet opening disposed in the housing, namely the refrigerant outflow line is guided around the housing through the wall of the housing. The through-opening formed in the refrigerant outflow line means an opening formed in the wall of the refrigerant outflow line, and the opening connects the capacity surrounded by the wall to the periphery of the line. Preferably, the refrigerant outflow line has a curved tubular shape, in particular a J shape. In this case, the through-opening is preferably formed in a blockage section, i.e. in a lower region or at the direction change point of the outflow line. The refrigerant outflow line may have a U shape or another shape in addition to having a J shape, and/or may be formed as a coaxial pipe.

The lower region of the apparatus is preferably used to store a liquid refrigerant, whereas the upper region of the apparatus is preferably used to guide a refrigerant, to separate a steam refrigerant and a liquid refrigerant, and particularly to discharge the steam refrigerant.

According to an improvement of the present invention, the apparatus according to the present invention has a refrigerant supply line connected into the housing above the level of refrigerant. Preferably, the apparatus has a cover member disposed in the housing. The cover member is spaced apart from the inlet opening of the refrigerant outflow line between the refrigerant supply line and the inlet opening of the refrigerant outflow line so that the inlet opening is protected from the refrigerant introduced into the housing through the refrigerant supply line. The cover member is used to separate a liquid refrigerant and a gas refrigerant. The formation of the cover member prevents the liquid refrigerant as a water droplet from being drawn into the inlet opening of the refrigerant outflow line, which is a steam inlet, and prevents the separation and storage function of the apparatus from being deteriorated due to the introduction of the refrigerant.

In particular, the apparatus for separating and storing liquid refrigerant according to the present invention is referred to as a collector or an accumulator depending on the arrangement in the refrigerant circuit. When the apparatus is disposed in the low-pressure region of the refrigerant circuit, i.e. when the apparatus is disposed between an evaporator and a compressor in the flow direction of refrigerant, the apparatus is referred to as an accumulator. When the apparatus is disposed in the high-pressure region of the refrigerant circuit, i.e. when the apparatus is disposed next to a condenser/gas cooler in the flow direction of refrigerant, the apparatus is referred to as a collector.

According to a preferable embodiment of the present invention, the boiling element has outlet openings. Each of the outlet openings has a maximum hydraulic diameter of 30 mm. In this case, the flow-through area of the boiling element is a sum of the flow-through cross-sectional areas of the outlet openings, and is larger than the flow-through cross-sectional area of the through-opening formed in the refrigerant outflow line. Each of the outlet openings may have a circular shape. Alternatively, the outlet opening may have a star shape, a square shape, a rectangular shape, a polygonal shape, an oval shape, and/or an irregular shape.

According to a preferable embodiment of the present invention, the boiling element has a cylindrical shape, particularly a hollow cylindrical shape. In addition, the boiling element preferably has a circular cross section.

According to an improvement of the present invention, a filter member is disposed in the through-opening. In this case, it is preferable that the filter member has a shape corresponding to the boiling element and has cylindrical shape, particularly a hollow cylindrical shape. Preferably, the filter member has a circular cross section.

According to a first alternative embodiment of the present invention, the boiling element is disposed on the same axis as the filter member. In this case, it is preferable that the boiling element is disposed such that the inner surface of the boiling element is adjacent to the outer surface of the filter member or the outer surface of the boiling element is adjacent to the inner surface of the filter member. Thus, the boiling element seals the filter member or the filter member seals the boiling element. As a result, the mass flow of the refrigerant flowing through the through-opening is generally guided through the filter member as well as the boiling element.

According to a second alternative embodiment of the present invention, the boiling element and the filter member are formed in an integral structure. The integral structure means a unit formed as a single component. In this case, it is preferable that the integral structure formed of the boiling element and the filter member has a circular cross section, i.e. a hollow cylindrical shape having outer and inner regions. Preferably, the filter member is disposed in the outer or inner region of the structure or in the region of the outlet openings.

According to an additional alternative embodiment of the present invention, the boiling element and/or the filter member has a shape other than the cylindrical shape. In this case, the boiling element and/or the filter member has, for example, a spherical shape, an oval shape, a polygonal shape, a sharp tip shape, or a blunt tip shape, and also has an irregular shape. The boiling element and the filter member may basically have different shapes.

Moreover, the apparatus according to the present invention may be used as a component of a coupling unit configured of an accumulator and an internal heat exchanger in the above preferable embodiments. In this case, the internal heat exchanger means a heat exchanger in the circuit, which is used for the purpose of heat transfer between the refrigerant in the high-pressure region and the refrigerant in the low-pressure region. In this case, for example, the liquid refrigerant, on the one hand, continues to be cooled after condensation, and the suction gas is, on the other hand, superheated before the compressor.

The accumulator according to the present invention has an advantage of increasing the contact surface with a refrigerant present in liquid phase by the boiling element disposed in the housing. Due to the increase of the contact surface, there is a high possibility of forming steam bubbles in the liquid refrigerant, and the boiling process outside the refrigerant outflow line is introduced as intended. Therefore, the risk of retardation of boiling is reduced even though a rapid pressure drop occurs in the accumulator. As a result, the initial formation of steam bubbles is used to prevent the retardation of boiling, e.g. noise such as a sound of explosion generated in the accumulator due to the retardation of boiling. Thus, by such a manner, the unintended noise causing the retardation of boiling is prevented and the soundproof of the system is improved. In addition, it is ensured that the accumulator and the additional parts of the refrigerant circuit of the compression refrigerator have a relative low load without the sudden variation in pressure, thereby increasing the overall life of the refrigerator.

The compression refrigerator may be operated as a heat pump, and therefore it can be seen that the accumulator according to the present invention may be used for a heat pump system as well as the compression refrigerator.

The boiling element of the accumulator may be made of a porous material or a porous material for manufacture, particularly for facilitating to form a bubble nucleus, instead of a perforated material. For example, the boiling element may be used as a sintered body having a defined porosity. In addition, metal, polymer, or ceramic may be considered as the material for manufacture. When a porous material is preferably used to manufacture the boiling element, it is possible to realize a small weight and a large contact surface with refrigerant in a small space. In this case, it is possible to facilitate the formation of steam bubbles and all materials matched with oil and refrigerant may be properly used. Preferably, the accumulator may be used for various refrigerants. The housing, the refrigerant guide lines, and the boiling element are made of a material resistant to refrigerants such as R134a, R1234yf, R1234ze, R744, R600a, R290, R152a, and R32, a mixture thereof, and oil. Aluminum or an aluminum alloy is preferable as the material. The reason is because aluminum has a high mechanical strength, a small weight, and a high durability.

The steam bubbles are created using aluminum or using a material such as copper, brass, stainless steel, or plastic, the surface of which is treated at a low quality. Accordingly, the boiling element has a surface roughness as high as possible, particularly may have a surface roughness higher than $R_a$ 3.2 μm. The surface of the boiling element may be processed, for example, by various methods such as milling, etching, or sand blasting. In this case, it is possible to facilitate the formation of steam bubbles and all materials matched with oil and refrigerant may be properly used.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
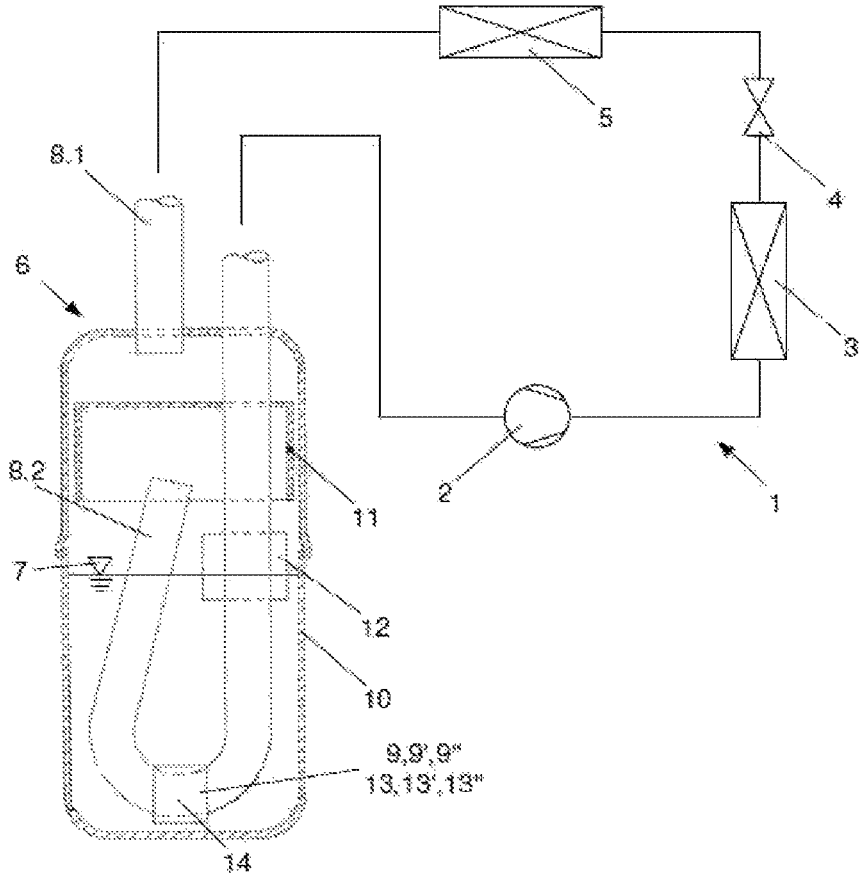
FIG. 1 is a view illustrating an apparatus for separating and storing liquid refrigerant, which includes a boiling element disposed in a refrigerant outflow line and is a component of a refrigerant circuit of a compression refrigerator.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

FIG. 1 illustrates an apparatus for separating and storing liquid refrigerant 6, which includes a boiling element 9, 9', or 9" disposed in a refrigerant outflow line 8.2 and is a component of a refrigerant circuit 1 of a compression refrigerator.

The refrigerant circuit 1 includes a compressor 2 which compresses a gas refrigerant and/or a liquid refrigerant, a heat exchanger 3 which is operated as a condenser or a gas cooler, an expansion member 4, and a heat exchanger 5 which is operated as an evaporator, in addition to an accumulator 6, and they are arranged in the flow direction of refrigerant. In this case, the accumulator 6 is disposed between the evaporator 5 and the compressor 2. The accumulator 6 serves as a collector and may be located at another position of the refrigerant circuit 1, e.g. may be positioned next to the high-pressure side heat exchanger 5. For example, when a refrigerant is liquefied in subcritical operation in which R134a refrigerant is used or in particular surroundings in which carbon oxide is used, the heat exchanger 5 is used as a condenser. A portion of heat transfer is performed at a certain temperature. The temperature of refrigerant is uniformly decreased during supercritical operation or supercritical heat dissipation in the heat exchanger 5. In this case, the heat exchanger 5 is used as a gas cooler. The supercritical operation may be conducted, e.g. in the particular surroundings or the operation mode of the refrigerant circuit 1 in which carbon oxide is used.

A refrigerant supply line 8.1 extends between the evaporator 5 and a housing 10 of the accumulator 6, and the housing 10 is defined as a refrigerant collection container. The refrigerant supply line is connected to the housing 10 from above. A refrigerant outflow line 8.2 having a J-shaped tubular shape is disposed in the housing 10. The refrigerant outflow line is used for recirculation of gas refrigerant and oil to the compressor 2 of the refrigerant circuit 1. The refrigerant outflow line 8.2 has an inlet opening disposed above a level of refrigerant 7 for suction of gas refrigerant. In this case, the level of refrigerant refers to a boundary between liquid refrigerant and gas refrigerant and a filling level of refrigerant. The J-shaped refrigerant outflow line 8.2 has a blockage section formed in the lower region of the housing 10, and a filter member 13, 13', or 13" is disposed in the blockage section. The filter member 13, 13', or 13" is used to filter the mass flow of oil or liquid refrigerant which passes therethrough. In this case, the mass flow of oil or liquid refrigerant is sucked through a through-opening 14 formed in the refrigerant outflow line 8.2. Here, the through-opening 14 is used as a bore hole for oil. The filter member 13, 13', or 13" called an oil filter is used to prevent the through-opening 14 from being clogged with unintended solid particles.

The housing 10 of the accumulator 6 has a cover member 11 disposed therein in order to protect the inlet opening for gas refrigerant of the refrigerant outflow line 8.2 from the unintended introduction of refrigerant into the housing 10 through the refrigerant supply line 8.1. The cover member 11 is used as a baffle plate for refrigerant introduced into the housing 10 through the refrigerant supply line 8.1. The inlet opening for gas refrigerant of the refrigerant outflow line 8.2 is protected and disposed beneath the cover member 11 such that the mixture of gas refrigerant and liquid refrigerant introduced into the accumulator 6 through the refrigerant supply line 8.1 reaches the cover member. The liquid refrigerant is guided to the lower power of the accumulator 6 along the cover member 11. The steam or gas refrigerant is introduced into the refrigerant outflow line 8.2 through the inlet opening disposed so as to be protected beneath the cover member 11.

In order to remove moisture circulated in the refrigerant circuit 1, an additional drier member 12 is disposed in the vicinity of the level of refrigerant 7. The drier member 12 has a pocket shape and a hygroscopic property. The drier member may be completely disposed beneath or above the level of refrigerant 7 according to the embodiments. Thus, the drier member may be disposed in a gas-phase region.

The housing 10 of the accumulator 6 has a boiling element 9, 9', or 9" arranged therein, and the boiling element 9, 9', or 9" is provided as a geometric boiling means in order to increase a solid surface area for contact with the liquid refrigerant. In this case, the boiling element 9, 9', or 9" is disposed in the blockage section of the J-shaped refrigerant outflow line 8.2, in particular in the filter member 13, 13', or 13" and beneath the level of refrigerant 7. The boiling element 9, 9', or 9" is perfectly surrounded by the liquid refrigerant.

Each individual part of the accumulator 6 is preferably made of aluminum or an aluminum alloy. In addition, each of refrigerant guide lines interconnecting the parts of the refrigerant circuit 1 of the compression refrigerator is preferably made of aluminum or an aluminum alloy.

Figure 2:
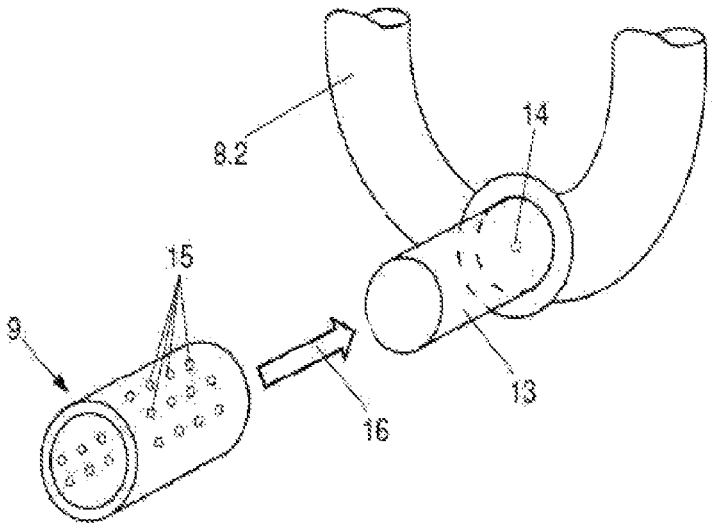
FIGS. 2 and 3 are views illustrating a blockage section of a J-shaped refrigerant outflow line, which is formed with a through-opening, a filter member, and a boiling element.
Figure 3:
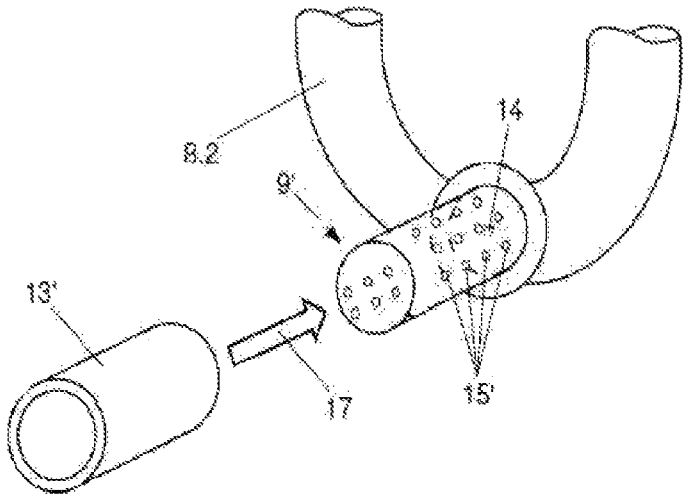

FIGS. 2 and 3 illustrate the blockage section of the J-shaped refrigerant outflow line 8.2, which is formed with the through-opening 14 defined as a bore hole for oil and the filter member 13 or 13', and the boiling element 9 or 9' as a geometric boiling means, in the apparatus 6.

According to the embodiment illustrated in FIG. 2, the filter member 13 has a cylindrical shape. In this case, the liquid, which is formed of oil and refrigerant and is filtered, may pass through only the side surface of the cylindrical filter member 13 and be discharged from the end surface thereof arranged toward the through-opening 14. The liquid may not pass through the end surface of the filter member 13 which is arranged toward the through-opening 14. Similarly, the boiling element 9 has a cylindrical shape, in particular a hollow cylindrical shape. Preferably, the boiling element 9 made of plastic has a shape corresponding to the filter member 13. Thus, the inner surface of the boiling element 9 is tightly coupled to the outer surface of the filter member 13. The inner surface or inner side surface of the cylindrical boiling element 9 comes into contact with the outer surface of the filter member 13 in such a manner that the boiling element 9 seals the filter member 13. The boiling element 9 and the filter member 13 are disposed on the same axis. In this case, the boiling element 9 seals the filter member 13 in such a manner that all of the liquid, which is sucked into the refrigerant outflow line 8.2 through the through-opening 14 and is filtered, passes through the wall of the boiling element 9 and then passes through the side surface of the filter member 13 forming the area thereof. The boiling element 9 is disposed upstream of the filter member 13 and the through-opening 14 in the flow direction of liquid.

During the installation of the apparatus 6, the boiling element 9 is pushed onto the filter member 13 in a movement direction 16 to be securely fixed thereto. Thus, the boiling element 9 is fixedly arranged in the refrigerant outflow line 8.2, in particular on or around the filter member 13.

According to the embodiment illustrated in FIG. 3, the boiling element 9' has a cylindrical shape. The liquid, which is formed of oil and refrigerant and is filtered, may pass through only the side surface of the cylindrical boiling element 9' and be discharged from the end surface thereof arranged toward the through-opening 14. The liquid may not pass through the end surface of the boiling element 9' which is arranged toward the through-opening 14. Similarly, the filter member 13' has a cylindrical shape, in particular a hollow cylindrical shape. The filter member 13' has a shape corresponding to the boiling element 9'. Thus, the inner surface of the filter member 13' comes into contact with the outer surface of the boiling element 9'. The inner surface or inner side surface of the cylindrical filter member 13' comes into contact with the outer surface of the boiling element 9' in such a manner that the filter member 13' seals the boiling element 9'. The filter member 13' and the boiling element 9' are disposed on the same axis. In this case, the filter member 13' seals the boiling element 9' in such a manner that all of the liquid, which is sucked into the refrigerant outflow line 8.2 through the through-opening 14 and is filtered, passes through the side surface of the filter member 13' forming the area thereof and then passes through the wall of the boiling element 9'. The boiling element 9' is disposed downstream of the filter member 13' and upstream of the through-opening 14 in the flow direction of liquid.

During the installation of the apparatus 6, the filter member 13' is pushed onto the boiling element 9' in a movement direction 17 to be securely fixed thereto. Thus, the filter member 13' is fixedly arranged in the refrigerant outflow line 8.2, in particular around the boiling element 9'.

Regardless of the embodiment illustrated in FIG. 2 or 3, the filter member 13 or 13' includes, for example, a part (not shown) having an inverse hook shape. The part expands after the boiling element 9 or 9' is coupled to the filter member 13 or 13', so as to fix the boiling element 9 or 9'. According to an alternative example of the apparatus 6, the boiling element 9 is fixed to the filter member 13, or the filter member 13' is fixed to the boiling element 9'. In this case, one of the boiling element 9 or 9' and the filter member 13 or 13' or each of them has a conical shape. Similarly, the boiling element 9 or 9' and the filter member 13 or 13' may be adhered or pressed to each other. Such a future pressing process is performed by an end cap (not shown) disposed on the front end surface of either of the boiling element 9 or 9' and the filter member 13 or 13'. The front end surface is formed on the end surface of the associated boiling element 9 or 9' or the filter member 13 or 13' which is arranged toward the through-opening 14. Alternatively, the boiling element 9 or 9' and the filter member 13 or 13' may be coupled to each other in other manners. For example, the boiling element 9 is coupled to the filter member 13 by shrink fitting or using a snap ring, or the filter member 13' is coupled to the boiling element 9' by shrink fitting or using a snap ring. In addition, the boiling element 9 or 9' and the filter member 13 or 13' may be coupled to each other by local welding and/or peripheral welding. When the boiling element 9 or 9' is made of a rubber material, the boiling element 9 may be fixed to the filter member 13 in a self-maintained manner or the filter member 13' may be fixed to the boiling element 9' in a self-maintained manner. According to the embodiment of FIG. 2, the boiling element 9 has a smaller inner diameter than the outer diameter of the filter member 13 in the state in which they are not assembled to each other. According to the embodiment of FIG. 3, the boiling element 9' has a larger outer diameter than the inner diameter of the filter member 13' in the state in which they are not assembled to each other.

The wall of the boiling element 9 or 9' has outlet openings 15 or 15' formed as holes or bores. The outlet openings are regularly or irregularly distributed on the whole side surface of the boiling element. Each of the outlet openings 15 or 15' has a maximum hydraulic diameter of 30 mm. In this case, the flow-through area of the boiling element 9 or 9', i.e. the sum of the cross-sectional areas of the outlet openings 15 or 15' is larger than the flow-through cross-sectional area of the through-opening 14 formed in the refrigerant outflow line 8.2. According to an alternative example of the boiling element that is not illustrated in the drawings, the outlet openings may also be formed in the end surface of the boiling element which is arranged toward the through-opening 14 or may be formed only in the end surface of the boiling element which is arranged toward the through-opening 14. In this case, a liquid may pass through the end surface of the filter member 13 which is arranged toward the through-opening 14.

When the compressor 2 of the refrigerant circuit 1 is switched on, a gas refrigerant is sucked from the accumulator 6 through the refrigerant outflow line 8.2 to the compressor 2. Due to the suction of the refrigerant, a static pressure is formed inside the refrigerant outflow line 8.2 in the region of the through-opening 14. The static pressure is lower than a static pressure outside the refrigerant outflow line 8.2 at the same geodetic height. The driving static pressure difference generated in this state causes the mass flow of refrigerant introduced into the refrigerant outflow line 8.2 through the through-opening 14, and the mass flow of refrigerant has a fixed velocity in the through-opening 14. The mass flow of refrigerant passing through the through-opening 14 is entirely guided through the outlet openings 15 or 15' formed in the boiling element 9 or 9'. Since the side surface of the filter member 13 or 13' is in partial contact with the boiling element 9 or 9' due to the outlet openings 15 or 15' thereof, the flow velocity of refrigerant in the region of the outlet openings 15 or 15' of the boiling element 9 or 9' is higher than that in the side surface of the filter member 13 or 13', which is not in contact with the boiling element 9 or 9', namely in the arrangement of the filter member 13 or 13' without the boiling element 9 or 9'. If the flow velocity is increased in the side region of the filter member 13 or 13', the static pressure of liquid is locally reduced. When a liquid has a relatively low static pressure at the same temperature, the superheating of the liquid is increased. Hence, the increase in superheating results in a boiling process as driving force. The boiling process is introduced by additionally increasing the turbulence flow of liquid. The turbulence flow of liquid is realized by flow control through the outlet openings 15 or 15' of the boiling element 9 or 9'. In order to further increase the formation of turbulence and crystalline nucleus for boiling the liquid flowing in the boiling element 9 or 9', the boiling element 9 or 9' has a rough surface and/or the outlet openings 15 or 15' have sharp edges.

The rough surface of the boiling element 9 or 9' which is advantageous in forming the crystalline nucleus is processed, for example, by blasting, in particular sand blasting, compression, soldering or welding, roughing, planning, and/or other cutting. In addition, the rough surface of the boiling element 9 or 9' may be formed using a porous material. When the boiling element 9 or 9' is formed by injection molding, each of the outlet openings 15 or 15' may be sharply formed by inserting a sharp sleeve thereinto without deburring of the edge of the outlet opening 15 or 15', and/or may be sharply formed by making the radius of the outlet opening 15 or 15' small using an injection molding tool.

Figure 4:
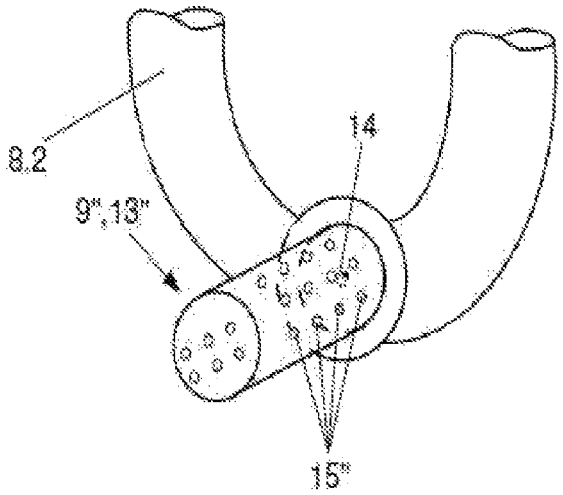
FIG. 4 is a view illustrating a blockage section of a J-shaped refrigerant outflow line, which has a through-opening and a structure in which a filter member and a boiling element are coupled to each other.

FIG. 4 illustrates a blockage section of a J-shaped refrigerant outflow line 8.2, which has a through-opening 14 and a structure in which a filter member 13" and a boiling element 9" are coupled to each other.

The embodiment illustrated in FIG. 4 generally corresponds to the embodiment illustrated in FIG. 2 or 3. However, the embodiment of FIG. 4 differs from the embodiment of FIG. 2 or 3 in that the filter member 13" and the boiling element 9" are integrally coupled to each other or are formed as a single cylindrical part. This ensures that the entire mass flow of fluid is guided to and filtered by the filter member 13". The filtering surface as the filter member 13" is formed in the outer or inner region of the structure in which the filter member 13" and boiling element 9" are integrated with each other or in the region of outlet openings 15". In this case, the filter member 13" is fixed to the boiling element 9" by splashing or bonding or, for example, using at least one inner or outer snap ring. According to the embodiment of FIG. 4, the complexity of parts can be lowered and the parts can be manufactured by minimum installation cost.

Meanwhile, the boiling element is generally a cylindrical element surrounding the filter, but the present invention is not limited thereto. For example, the boiling element may be provided in a sheet form that is fixed to the inner wall of the housing. Hereinafter, a boiling element in the form of sheet may be illustratively described with reference to FIGS. 5 to 8.

Figure 5:
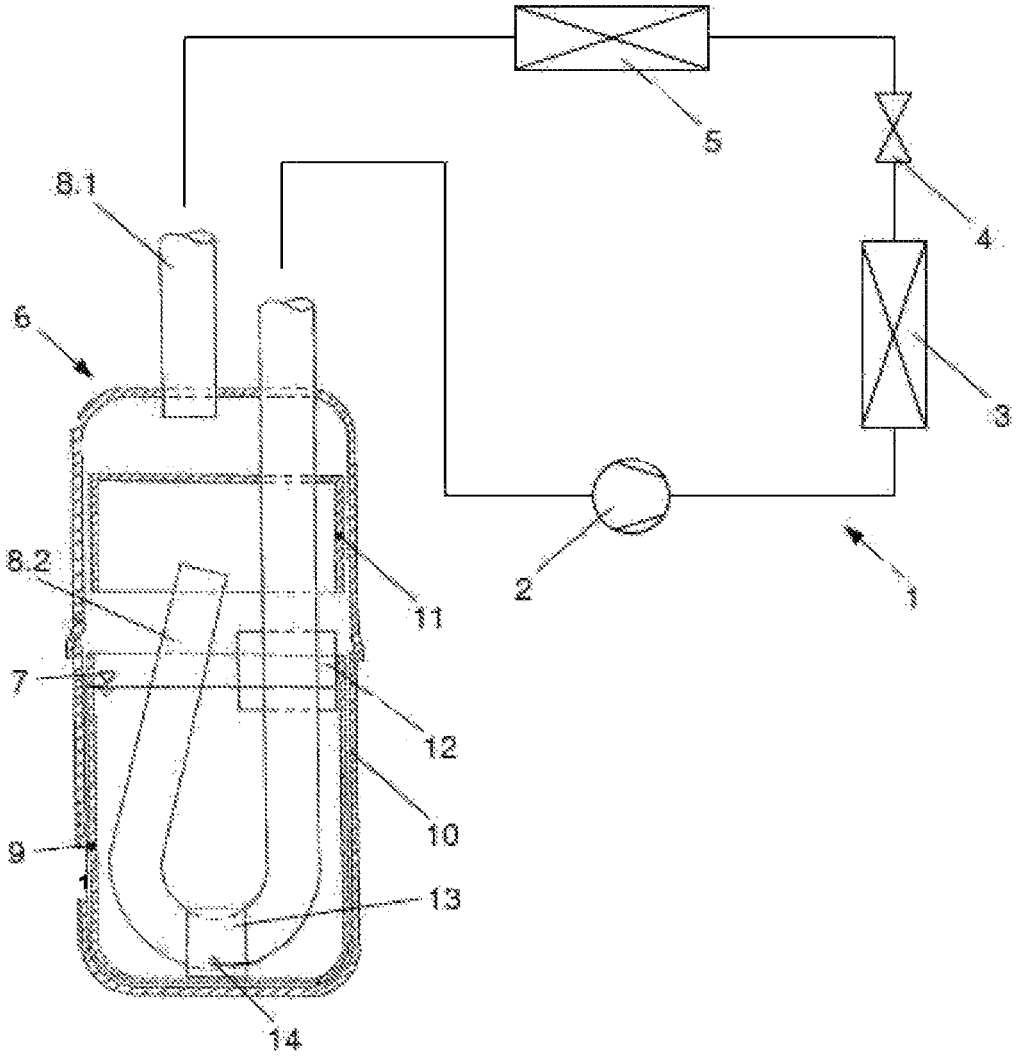
FIG. 5 is a view illustrating an apparatus for separating and storing liquid refrigerant, which includes a boiling element extending along the base and side of the lower region of the housing thereof, the boiling element having a U-shaped cross section.

Referring to FIG. 5, the housing 10 of the accumulator 6 has a boiling element 9 arranged therein, and the boiling element 9 is provided as a geometric boiling means in order to increase a solid surface area for contact with liquid refrigerant. In this case, the boiling element 9 is provided in a perforated sheet form, particularly in an aluminum sheet form, and the sheet-formed boiling element is tightly coupled to the lower region of the housing 10 which is formed similar thereto. Each individual hole formed in the sheet-formed boiling element has a diameter less than 20 mm. The sheet-formed boiling element may be completely disposed in the housing 10.

The boiling element 9 is formed and disposed such that the upper free end(s) of the boiling element 9 exceeds the level of refrigerant 7. The boiling element 9 is fixed to the lower region of the housing 10 by local welding, soldering, or spinning. Alternatively, the boiling element 9 may be fixed to the wall of the lower region of the housing 10 in other structural manners. For example, the boiling element 9 may be fixed to the wall of the lower region of the housing 10 in such a way to have a conical shape, or may be fixed to the wall of the lower region of the housing 10 by crimping or pressing. Besides, the boiling element 9 may be maintained on the base of the lower region of the housing 10 with the aid of the refrigerant outflow line 8.2. In this case, the sheet-formed boiling element 9 is fixed between the refrigerant outflow line 8.2 and the wall of the housing 10.

The edge of the sheet-formed boiling element 9, in particular the edge of each hole thereof has a sharp shape. When the refrigerant circuit 1 is first operated, namely when the compressor 2 is switched on and thus the pressure in the accumulator 6 is simultaneously dropped, the sharp edges of the holes form steam bubbles. When the compressor 2 is switched on, a refrigerant is sucked from the accumulator 2, thereby causing the level of refrigerant 7 to be moved downward. Due to the downward movement of the level of refrigerant 7, a liquid has a relative velocity between the level of refrigerant 7 and the boiling element 9. The relative velocity of liquid facilitates to form steam bubbles in the liquid, together with the surface of the boiling element, particularly the sharp edges of the holes. Therefore, as a result of the suction of refrigerant through the compressor 2, it is possible to reduce the sudden retardation of boiling of the liquid in the accumulator 6, which is caused due to the drop of the suction pressure in the accumulator 6, and to prevent unintended noise from occurring. The rough surface of the boiling element 9 facilitates to introduce an additional boiling process in the region in which the relative velocity of liquid is not generated between the level of refrigerant 7 and the boiling element 9, with the consequence that the sudden retardation of boiling is reduced.

Each individual part of the accumulator 6 is preferably made of aluminum or an aluminum alloy. In addition, each of refrigerant guide lines interconnecting the parts of the refrigerant circuit 1 of the compression refrigerator is preferably made of aluminum or an aluminum alloy.

In the following drawings, like reference numerals refer to like parts illustrated in FIG. 5.

Figure 6:
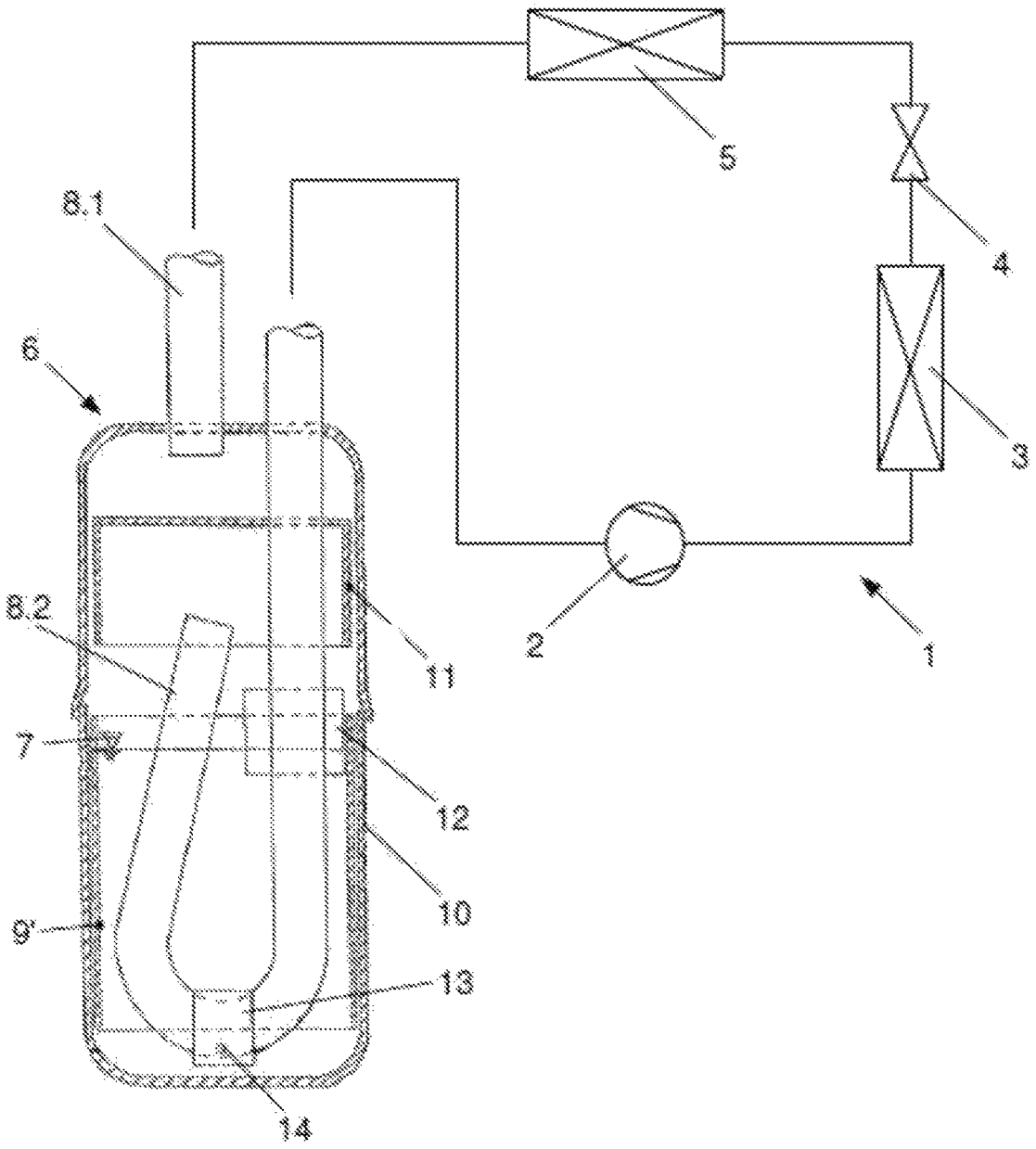
FIG. 6 is a view illustrating an apparatus for separating and storing liquid refrigerant, which includes a boiling element extending along the side of the lower region of the housing thereof, the boiling element having a ring or cylindrical shape.

FIG. 6 illustrates an apparatus for separating and storing liquid refrigerant 6, which includes a boiling element 9' extending along the side of the lower region of the housing 10 thereof, the boiling element having a ring or cylindrical shape, and which is a component of a refrigerant circuit 1 of a compression refrigerator. The accumulator 6 of the embodiment illustrated in FIG. 6 basically corresponds to the accumulator 6 of the embodiment illustrated in FIG. 5. However, the accumulator 6 in FIG. 6 differs from the accumulator 6 in FIG. 5 in that the boiling element 9' is provided in the form of ring or cylindrical sheet. The boiling element 9' is not formed in the base of the lower region of the housing 10. The boiling element 9' may selectively have a conical shape. Since the boiling element 9' has a less complicated shape compared to the embodiment of FIG. 5, the contact surface with liquid refrigerant is reduced and it is advantageous in terms of manufacturing and costs.

Besides, similar to the above embodiment, the sheet-formed boiling element 9' is tightly coupled to the side wall of the lower region of the housing 10 and has holes again. The boiling element 9' is disposed such that the upper free end(s) of the boiling element 9' exceeds a level of refrigerant 7.

Figure 7:
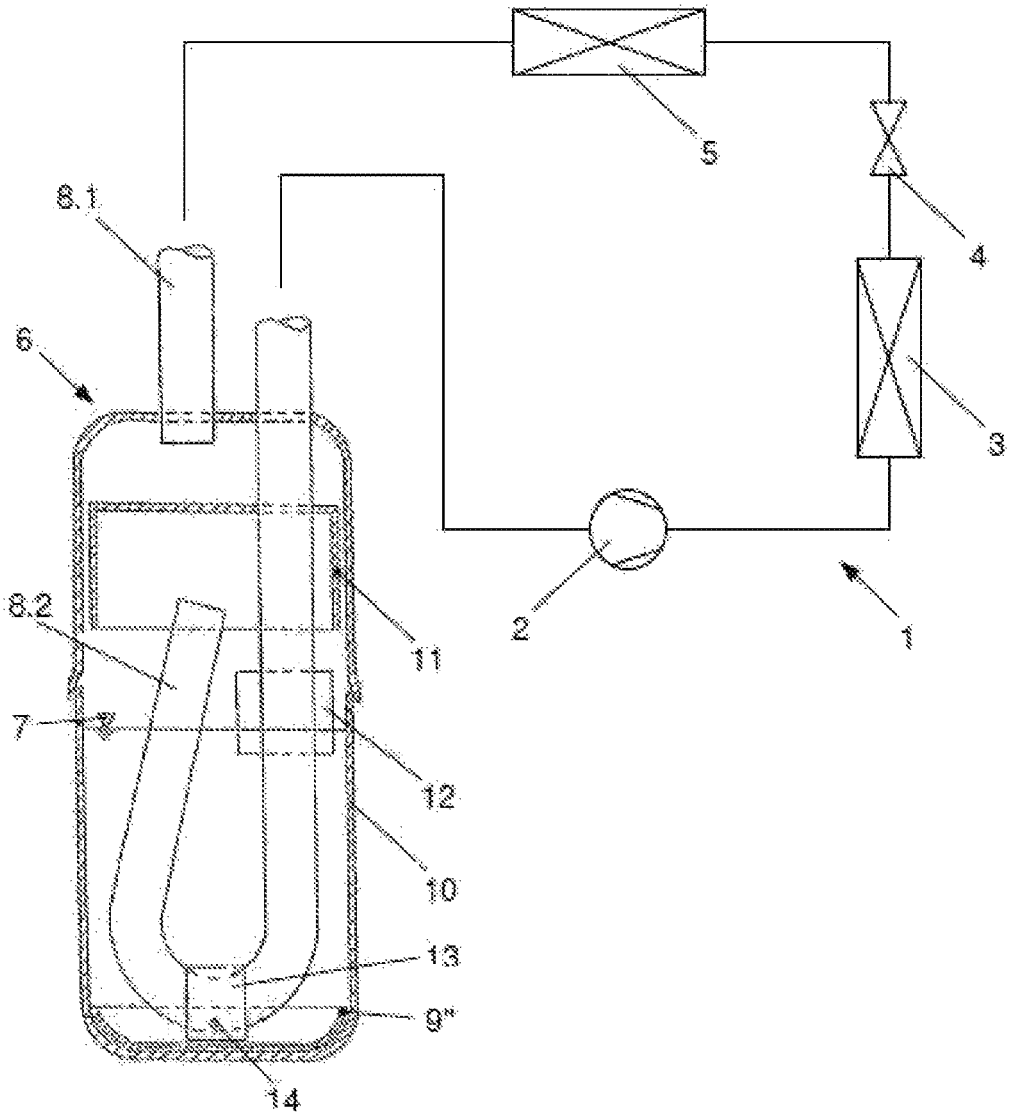
FIG. 7 is a view illustrating an apparatus for separating and storing liquid refrigerant, which includes a boiling element extending along the base of the lower region of the housing thereof, the boiling element having a trough shape.

FIG. 7 illustrates an apparatus for separating and storing liquid refrigerant 6, which includes a boiling element 9" extending along the base of the lower region of the housing 10 thereof, the boiling element having a trough shape, and which is a component of a refrigerant circuit 1 of a compression refrigerator. The accumulator 6 of the embodiment illustrated in FIG. 7 basically corresponds to the accumulator 6 of the embodiment illustrated in FIG. 5. However, the accumulator 6 in FIG. 7 differs from the accumulator 6 in FIG. 5 in that the boiling element 9" is provided in a sheet form having a trough shape. The boiling element 9" does not have a cylindrical region. The boiling element 9" may selectively have a flat disk shape. Since the boiling element 9" has a less complicated shape compared to the embodiment of FIG. 5, the contact surface with liquid refrigerant is reduced and it is advantageous in terms of manufacturing and costs. In addition, it may be considered that the boiling element 9" and the lower region of the housing 10 are manufactured by deep drawing in a single process.

Similar to the above embodiment, the sheet-formed boiling element 9" having holes is disposed so as to be tightly coupled to the base of the lower region of the housing 10.

Figure 8:
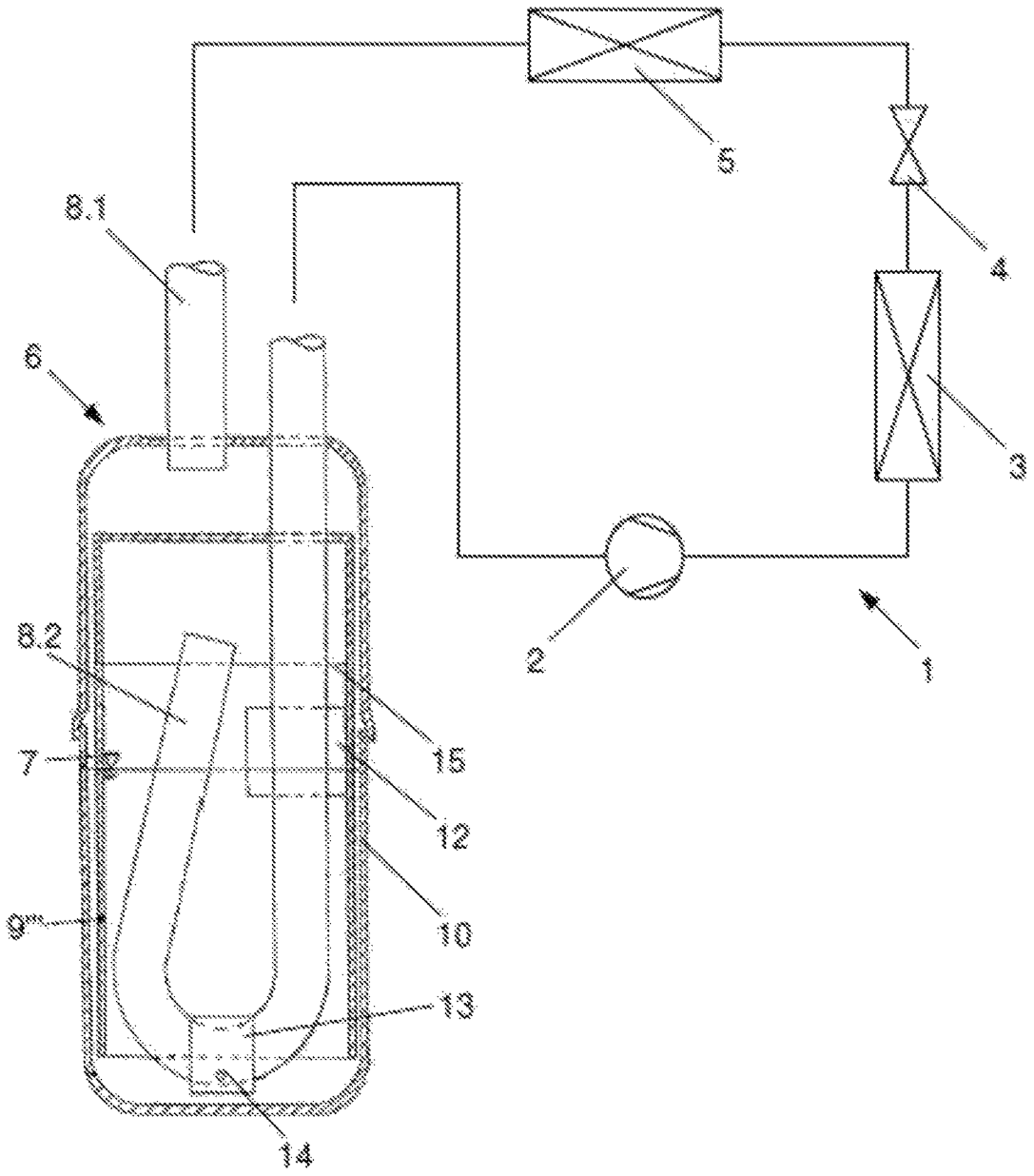
FIG. 8 is a view illustrating an apparatus for separating and storing liquid refrigerant, which includes a boiling element extending inward along the side of the upper region of the housing thereof, the boiling element having a closed U-shaped upper surface in section.

FIG. 8 illustrates an apparatus for separating and storing liquid refrigerant 6, which includes a boiling element 9''' extending inward along the sides of the upper and lower regions of the housing 10 thereof, the boiling element having a closed U-shaped upper surface in section, and which is a component of a refrigerant circuit 1 of a compression refrigerator. The accumulator 6 of the embodiment illustrated in FIG. 8 basically corresponds to the accumulator 6 of the embodiment illustrated in FIG. 6. However, the accumulator 6 in FIG. 8 differs from the accumulator 6 in FIG. 6 in that the boiling element 9" has a structure in which a boiling element 9' is integrated with a cover member 11. In this case, the boiling element 9''' has an upper portion which is formed as the cover member 11 and a lower portion which is formed in a ring or cylindrical shape in section. The lower portion of the boiling element 9''' extends along the side of the housing 10 of the accumulator 6. The upper and lower portions of the boiling element 9''' extend from opposite sides to a large region 15 defined to surround the periphery thereof.

The upper portion of the boiling element 9''' is formed above the region 15, functions as the cover member 11 according to the embodiments of FIGS. 5 to 7, and does not have holes. The lower portion of the boiling element 9''' provided in a perforated sheet is formed beneath the region 15. Similarly, the lower portion of the boiling element 9''' is tightly coupled to the wall of the housing 10.

In particular, a gas refrigerant flows through the holes of the boiling element 9''' between the region 15 and a level of refrigerant 7. The gas refrigerant is sucked through a refrigerant outflow line 8.2 from a compressor 2. Since the boiling element 9''' has a less complicated shape compared to the embodiment of FIG. 6, it is advantageous in terms of manufacturing and costs. The complexity of the accumulator 6 is reduced in the vicinity of parts. In addition, the degree of separation in the accumulator 6 is increased, thereby allowing a small amount of liquid refrigerant to flow toward the compressor 2. Therefore, it is possible to prevent the compressor 2 from being damaged.

While the present invention has been described with respect to the specific embodiments, it will be apparent to those skilled in the art that various changes and modifications may be made without departing from the spirit and scope of the invention as defined in the following claims.

What is claimed is:

1. An apparatus for separating and storing a liquid refrigerant in a refrigerant circuit, the apparatus comprising:

a housing configured as a refrigerant collection container, the housing including a base and at least one sidewall extending upwardly from a perimeter of the base;

a refrigerant outflow line disposed in the housing and extending from an inlet opening disposed above a level of the liquid refrigerant, via a liquid refrigerant region, to outside the housing, the refrigerant outflow line having a through-opening formed in the liquid refrigerant region;

a boiling element presented as a geometric structure having a solid surface for contact with the liquid refrigerant disposed in the housing, wherein the boiling element causes a drop in pressure in the liquid refrigerant through contact between the liquid refrigerant and the solid surface of the boiling element when the liquid refrigerant passes through the housing and towards the through-opening by suction of a gas refrigerant, wherein the boiling element is tightly coupled to an inner surface of the at least one sidewall of the housing, wherein the boiling element is a perforated sheet having holes formed therethrough with each of the holes having a diameter of less than 20 mm, and wherein the liquid refrigerant is introduced into the refrigerant outflow line after passing by the boiling element and passing through the through-opening; and a filter member disposed in the through-opening.

2. The apparatus according to claim 1, wherein the boiling element is tightly coupled to the inner surface of the at least one sidewall of the housing within a lower region of the housing.

3. The apparatus according to claim 2, wherein the boiling element is completely disposed on the at least one sidewall of the housing.

4. The apparatus according to claim 2, further comprising:

a refrigerant supply line connected to the housing above the level of the liquid refrigerant, wherein the refrigerant outflow line has a bent tubular shape, and wherein the inlet opening of the refrigerant outflow line is disposed above the level of the liquid refrigerant; and a cover member disposed in the housing, the cover member spaced apart from the inlet opening of the refrigerant outflow line between the refrigerant supply line and the inlet opening of the refrigerant outflow line, wherein the inlet opening is protected from introduction of refrigerant into the housing through the refrigerant supply line, and wherein the boiling element extends inward along at least one side of an upper region of the housing, and has a closed upper surface to form the cover member.

5. The apparatus according to claim 1, wherein the boiling element has a U-shaped cross section.

6. The apparatus according to claim 1, wherein the boiling element is tightly coupled to the base of the housing.

7. The apparatus according to claim 1, wherein the boiling element has a cylindrical shape.

8. The apparatus according to claim 1, wherein the boiling element is disposed to exceed the level of the liquid refrigerant.

9. The apparatus according to claim 8, wherein the boiling element is disposed at least partially beneath the level of the liquid refrigerant, wherein a portion of the boiling element disposed beneath the level of the liquid refrigerant includes the holes formed therein.

* * * * *